US008985972B2

(12) United States Patent
Tetzlaff et al.

(10) Patent No.: US 8,985,972 B2
(45) Date of Patent: Mar. 24, 2015

(54) ISOLATING WET CONNECT COMPONENTS FOR DEPLOYED ELECTRICAL SUBMERSIBLE PUMPS

(75) Inventors: Steven K. Tetzlaff, Owasso, OK (US); John Bearden, Claremore, OK (US); Ken Bebak, Tulsa, OK (US); William H. Milne, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 674 days.

(21) Appl. No.: 13/290,170

(22) Filed: Nov. 7, 2011

(65) Prior Publication Data

US 2012/0118563 A1 May 17, 2012

Related U.S. Application Data

(60) Provisional application No. 61/413,716, filed on Nov. 15, 2010.

(51) Int. Cl.

| | |
|---|---|
| ***F04B 35/04*** | (2006.01) |
| ***E21B 43/18*** | (2006.01) |
| ***E21B 17/02*** | (2006.01) |
| ***F04B 17/04*** | (2006.01) |
| ***F04B 47/06*** | (2006.01) |

(52) U.S. Cl.

CPC ..... *E21B 43/18* (2013.01); *E21B 17/028* (2013.01); *F04B 17/04* (2013.01); *F04B 47/06* (2013.01)

USPC ..... 417/423.3; 166/65.1; 439/219; 200/51.12

(58) Field of Classification Search

CPC ..... F04D 13/086; E21B 43/128; H02K 5/132

USPC ..... 439/169, 219, 342, 482, 912; 200/51.52; 417/423.3, 423.6, 423.15, 417/423.14; 310/87; 166/241.3, 242.3, 166/65.1, 381, 383

See application file for complete search history.

(56) References Cited

U.S. PATENT DOCUMENTS

| | | | | |
|---|---|---|---|---|
| 3,631,275 | A * | 12/1971 | Conrad et al. | 310/71 |
| 3,842,298 | A * | 10/1974 | Schaefer | 310/87 |
| 6,179,585 | B1 * | 1/2001 | Kobylinski et al. | 417/423.3 |
| 6,899,532 | B2 * | 5/2005 | Eddy et al. | 417/410.1 |
| 7,611,339 | B2 * | 11/2009 | Tetzlaff et al. | 417/422 |
| 7,814,969 | B2 * | 10/2010 | Shaw | 166/65.1 |
| 2002/0050361 | A1 | 5/2002 | Shaw et al. | |
| 2009/0242212 | A1 * | 10/2009 | Shaw | 166/378 |
| 2010/0150739 | A1 | 6/2010 | Brookbank et al. | |

(Continued)

*Primary Examiner* — Devon Kramer
*Assistant Examiner* — Amene Bayou
(74) *Attorney, Agent, or Firm* — Bracewell & Giuliani LLP

(57) ABSTRACT

An electric motor of an electric submersible pump is electrically isolated from a power conduit for diagnostic testing of the power conduit and wet connection components in place within a wellbore. The electric motor is electrically connected to the power conduit through a wet connection assembly having motor leads in electrical connection with a transfer contact and a receptacle assembly disposed on a tubing string having a supply contact electrically connected to the power conduit. Electric power flows through the power conduit, through the supply contact, through the transfer contact, and through the motor leads to the motor. The supply contact and the transfer contact are separated by a sliding sleeve that hydraulically inserts between the contacts, insulating the transfer contact and grounding the supply contact for testing. The contacts may also be separated by a relative rotation of the assemblies that grounds the supply contact for testing.

21 Claims, 6 Drawing Sheets

(56) References Cited

U.S. PATENT DOCUMENTS

2010/0206577 A1* 8/2010 Martinez ..... 166/369
2010/0243263 A1 9/2010 Tetzlaff et al.
2010/0243264 A1 9/2010 Tetzlaff et al.
2011/0037332 A1 2/2011 Neuroth et al.

* cited by examiner

ISOLATING WET CONNECT COMPONENTS FOR DEPLOYED ELECTRICAL SUBMERSIBLE PUMPS

This application claims priority to and the benefit of U.S. Provisional Application No. 61/413,716, by Tetzlaff et al., filed on Nov. 15, 2010, entitled "Isolating Wet Connect Components for Deployed Electrical Submersible Pumps," which application is incorporated herein by reference.

BACKGROUND OF THE INVENTION

1. Field of the Invention

The present invention relates to downhole pumping systems submersible in well bore fluids. More specifically, the present invention provides for isolating electrical wet connect components for a submersible pump system to allow for diagnostic, operational, and other independent tests.

2. Brief Description of Related Art

Submersible pumping systems are often used in hydrocarbon producing wells for pumping fluids from within the wellbore to the surface. These fluids are generally liquids and include produced liquid hydrocarbon as well as water. One type of system used in this application employs an electrical submersible pump (ESP). ESPs are typically disposed at the end of a length of production tubing and have an electrically powered motor. Often electrical power may be supplied to the pump motor via a power cable. Normally, the power cable is strapped to the tubing and lowered along with the pump and the tubing. Typically, the pumping unit is disposed within the well bore just above where perforations are made into a hydrocarbon producing zone. ESP's typically require periodic retrieval for scheduled maintenance or repair. This usually entails removing the tubing and the power cable, which is secured alongside the tubing. Pulling and re-running the tubing is time consuming and pulling and reusing the power cable creates mechanical wear and can sometimes damage the cable.

Lowering the pumping assembly inside the production tubing avoids the need for pulling the tubing to retrieve the pump. Some well completions run the power cable on the tubing exterior and the pump through the tubing. The pump stacks into engagement with electrical contacts provided on the lower end of the power cable, in what is called a wet connection. These wet connections rely on component assemblies that create an electrical connection between an insertable/retrievable pumping system and a semi-permanent power conduit run with the production tubing. Once the wet connection is made, the completion or intervention devices or machines used to install the pumping system are moved away from the well. When the pumping system encounters problems, such as when the system becomes rotationally challenged, the pumping system and/or the power conduit must be pulled from the well, inspected, and remediated to repair the damaged component. Pulling both the pumping system and the power conduit requires a considerable expenditure of time and money. Thus, a system or apparatus that allowed for downhole isolation and testing of the pumping system and power conduit to determine the problem area so that only the failed component may be pulled and repaired is desirable.

SUMMARY OF THE INVENTION

These and other problems are generally solved or circumvented, and technical advantages are generally achieved, by preferred embodiments of the present invention that provide a method for isolating wet connect components for diagnostic testing of deployed systems.

In accordance with an embodiment of the present invention, an electric submersible pumping system is disclosed. The system includes a pumping system deployable through a well tubing string and having a pump with a fluid inlet and a pump motor mechanically coupled to the pump. The system also includes a receptacle assembly adapted to be secured to a lower end of the tubing string, and a power conduit for placement alongside the tubing. The power conduit is electrically connected to a plurality of supply contacts formed within the receptacle assembly. The system further includes a wet connect assembly coupled to the pumping system, having a plurality of transfer contacts and having motor lead lines electrically connecting the plurality of transfer contacts to the pump motor. The pumping system is deployable through the tubing string so that the wet connect assembly lands in the receptacle assembly with the supply contacts and the transfer contacts electrically connected to each other to supply electrical power through the power conduit to the motor. The system also includes an isolation assembly within the receptacle assembly that is selectively movable from a power transfer position to an isolation position to isolate the transfer contacts from the supply contacts for diagnostic testing of the power conduit.

In accordance with another embodiment of the present invention, an electric submersible pumping system is disclosed. The system includes a well tubing string disposed within a wellbore. The system further includes a pumping system deployable through the well tubing string and having a pump with a fluid inlet and a pump motor mechanically coupled to the pump. The system also includes a receptacle assembly adapted to be secured to a lower end of the tubing string, and a power conduit for placement alongside the tubing. The power conduit is electrically connected to a plurality of supply contacts formed within the receptacle assembly. The system further includes a wet connect assembly coupled to the pumping system, having a plurality of transfer contacts and having motor lead lines electrically connecting the plurality of transfer contacts to the pump motor. The pumping system is deployable through the tubing string so that the wet connect assembly lands in the receptacle assembly with the supply contacts and the transfer contacts electrically connected to each other to supply electrical power through the power conduit to the motor. The system also includes a hydraulic isolation assembly within the receptacle assembly that is selectively movable from a power transfer position to an isolation position to isolate the transfer contacts from the supply contacts for diagnostic testing of the power conduit.

In accordance with yet another embodiment of the present invention, a method for powering an electric motor of an electric submersible pump is disclosed. The method provides a receptacle assembly on a lower end of a tubing string and having a plurality of supply contacts on an inner diameter of the receptacle assembly. The method deploys the tubing string in a well and extending a power cable from the receptacle assembly alongside the tubing string. The method also provides a pump assembly with a wet connect assembly having a plurality of transfer contacts formed on an outer diameter of the wet connect assembly and motor lead lines electrically connecting the transfer contacts to a pump motor. The method lowers the pump assembly through the tubing string and engages the transfer contacts with the supply contacts. The method supplies electrical power to the pump motor through the power conduit, the supply contacts, the transfer contacts, and the motor lead lines to operate the pump assembly and to test integrity of the power cable. The method also remotely actuates an isolation assembly formed within the receptacle assembly to separate the transfer contacts from the supply contacts without withdrawing the pump assembly from the tubing string.

An advantage of the disclosed embodiments is that they provide a method to isolate wet connection components for diagnostic testing in place within a wellbore.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning ESP operation, construction, and the like have been omitted inasmuch as such details are not considered necessary to obtain a complete understanding of the present invention, and are considered to be within the skills of persons skilled in the relevant art.

Figure 1:
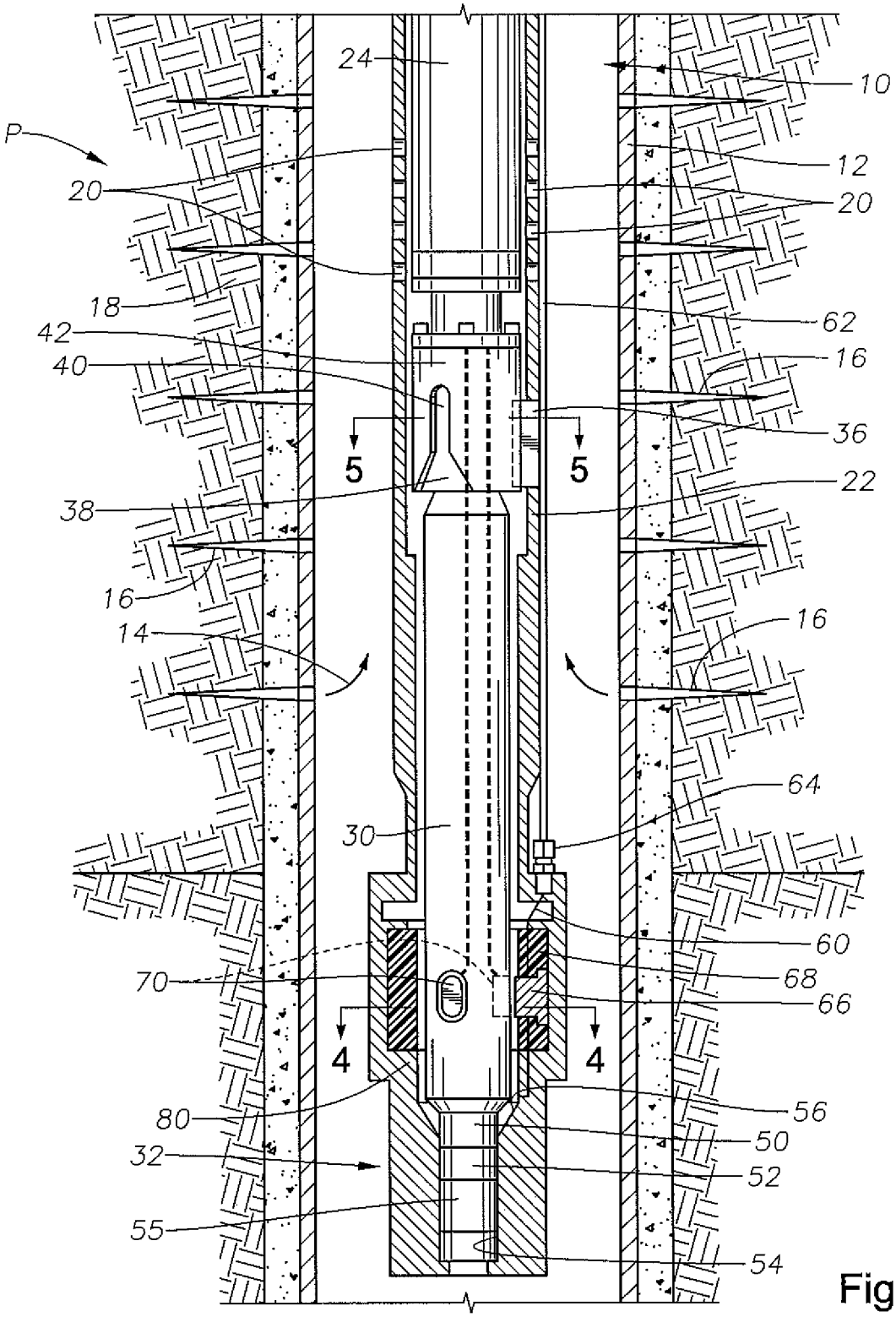
FIG. 1 is a vertical cross-sectional view of an electrical submersible pump assembly deployed in tubing in a wellbore.

In the drawings, FIG. 1 is a partial vertical cross-sectional view of an electrical submersible pump or ESP system P positioned at a depth of interest in a well borehole 10 lined with a casing 12. The pump causes upward movement of formation fluid as indicated by arrows 14 entering the well borehole 10 from perforations 16 which have been formed in a subsurface formation 18 through the casing 12. The formation fluid in well borehole 10 is delivered for pumping to the pump P via inlet passages 20 in a deployed outer body or outer housing 22 and then onto pump inlets for pumping by a pump motor 24 in the conventional manner.

An inserted assembly 30 attached below the pump P in the outer housing 22 is illustrated fully landed within a conductor shoe or receptacle assembly 32 formed at a lower end of the deployed outer housing 22. The inserted assembly 30 when fully landed within the receptacle assembly 32 anchors the pump system P for pumping operations by the pump motor 24 upwardly through production casing or tubing when electrical power is furnished.

The inserted assembly 30 when fully landed has its weight, along with the weight of the pump P, supported by the receptacle assembly 32. The inserted assembly 30 is landed and positioned within the receptacle assembly 32 by engaging a set of vertically longitudinally extending keys 36 which fit within vertically extending slots 40 in a corresponding set of profiled channels 38 on an adapter head 42. If desired, a single key 36, slot 40, and channel 38 may be used. In the illustrative embodiment, three keys 36 are provided, but it should be understood that other numbers of such components could be included.

Preferably the opening or openings on the channel(s) 38 are circumferentially disposed about the periphery of the inserted assembly 30 and are profiled with sufficient width so that the key or keys 36 may be fitted firmly therein. As the inserted assembly 30 is lowered to the fully landed position, the tapered surfaces of the channel 38 slide on upper surface portions of the key 36, which rotates the inserted assembly 30. The tapered surfaces of channel 38 slide on the key 36 during further downward movement, until the key 36 top is aligned and fitted within the constant width slot portion 40 in the fully landed position. At this point, the inserted assembly 30 drops to insert the key or keys 36 into the corresponding constant width slot portion 40 of the profiled channel 36. The fitted coupling of keys 38 and slots 40 when engaged prevents relative rotation between the inserted assembly 30 and the outer housing 22.

A plunger 50 and associated seal 52 mounted at a lower end of the inserted assembly 30 is positioned in a lower polished bore 54 formed in the outer housing 22. Optionally, a hydraulic motor 55 may be secured to a lower end of the inserted assembly 30 and adapted to rotate the inserted assembly 30 as described in more detail with respect to FIG. 4-7. As shown in FIG. 1, an upper polished bore 56 is formed in the outer housing 22 above the plunger 50 and the lower polished bore 54. The upper and lower polished bores in the outer housing 22 form a receiving chamber for the plunger 50 of the inserted assembly 30.

A suitable number of electrical supply conductors 60 extend downwardly in a conduit 62 and through a connection fitting 64 to electrically connect with a wet connect power supply contact 66. In the illustrative embodiment, three conductors 60 and corresponding wet connect power supply contacts 66 are provided in order that multiphase electrical power may be provided to the pump motor 24. It should be understood, however, that other numbers of such conductors and contact components could be utilized, if desired.

The power supply contact 66 is mounted in an insulative sleeve 68 within an insulative sleeve 69 in the inserted assembly 30. The wet connect power supply contact 66 extends inwardly and initially forms an electrical connection with a corresponding wet connect power transfer contact 70 mounted on an outer surface of the inserted assembly 30. The wet connect power transfer contact 70 is electrically connected by motor lead lines 72 to the pump motor 24 to furnish electrical power for pumping of formation fluids. Further details of the structure and arrangement of the wet connect electrical contacts 66 and 70 are set forth in commonly owned, co-pending U.S. patent application Ser. No. 12/413,243, filed Mar. 27, 2009, which is incorporated herein by reference.

The present invention provides a new and improved apparatus and method for isolating the wet connect electrical contacts 66 and 70 from each other for diagnostic and testing purposes while the pump system P is deployed in situ in the well borehole. This can be done at lower cost and without requiring that rig equipment be used to remove the ESP from the well borehole 10.

The isolation of the inserted pump motor 24 and assembly 32 from the deployed housing 22 and conduits 62 may be accomplished by hydraulic pressure or by relative rotational movement between the inserted and deployed components, or both, as will be set forth. Electrical testing can then be performed for diagnosis and remediation, such as a determination of whether a problem is in the pump or in the continuity or integrity of the electrical conductor 60 installed with the production conduit or tubing. The present invention allows diagnostic testing of the production conduit without removal of the pumping system P and the production tubing connected therewith.

Figure 2:
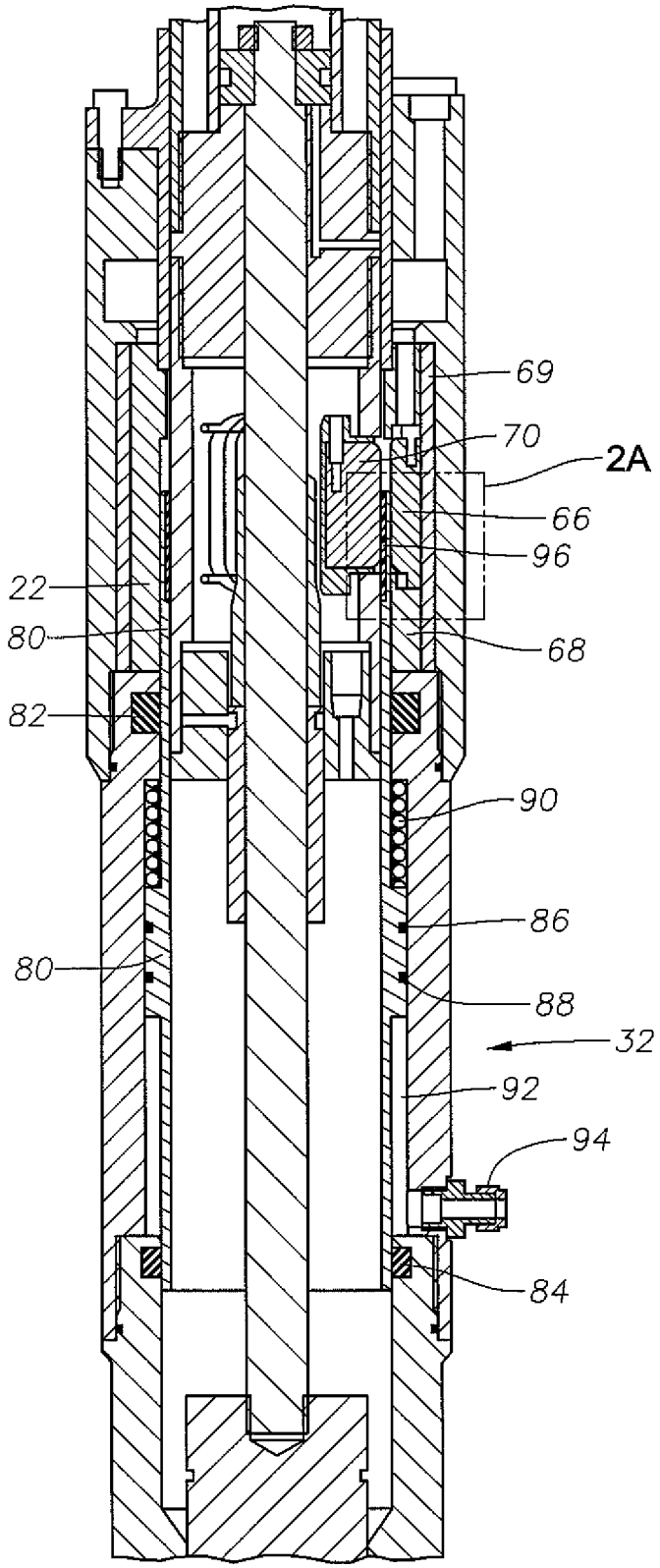
FIG. 2 is a vertical cross-sectional view of an assembly according to the present invention, with the wet connect components of the electrical submersible pump of FIG. 1 isolated from each other.
Figure 3A:
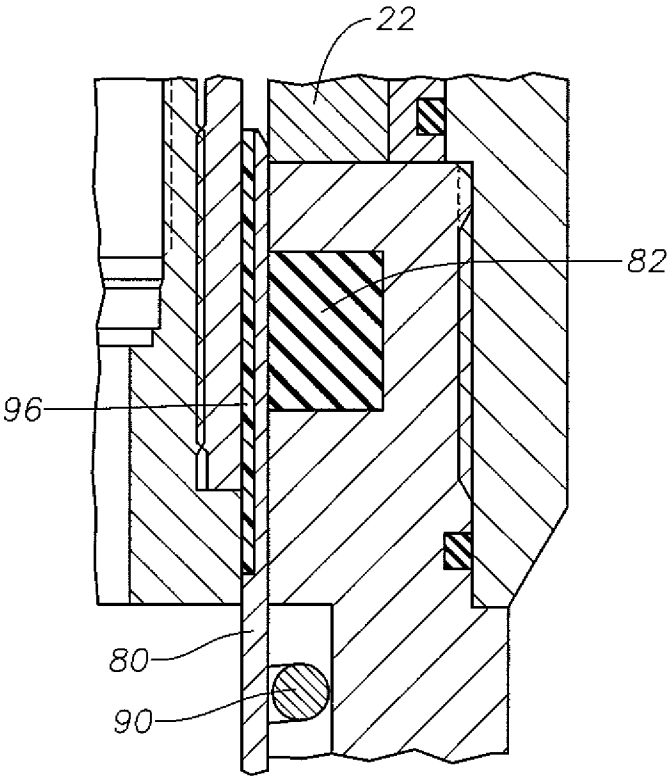
FIG. 3A is an enlarged view of a portion of the structure circled and identified by reference numeral 3A in FIG. 3.
Figure 3:
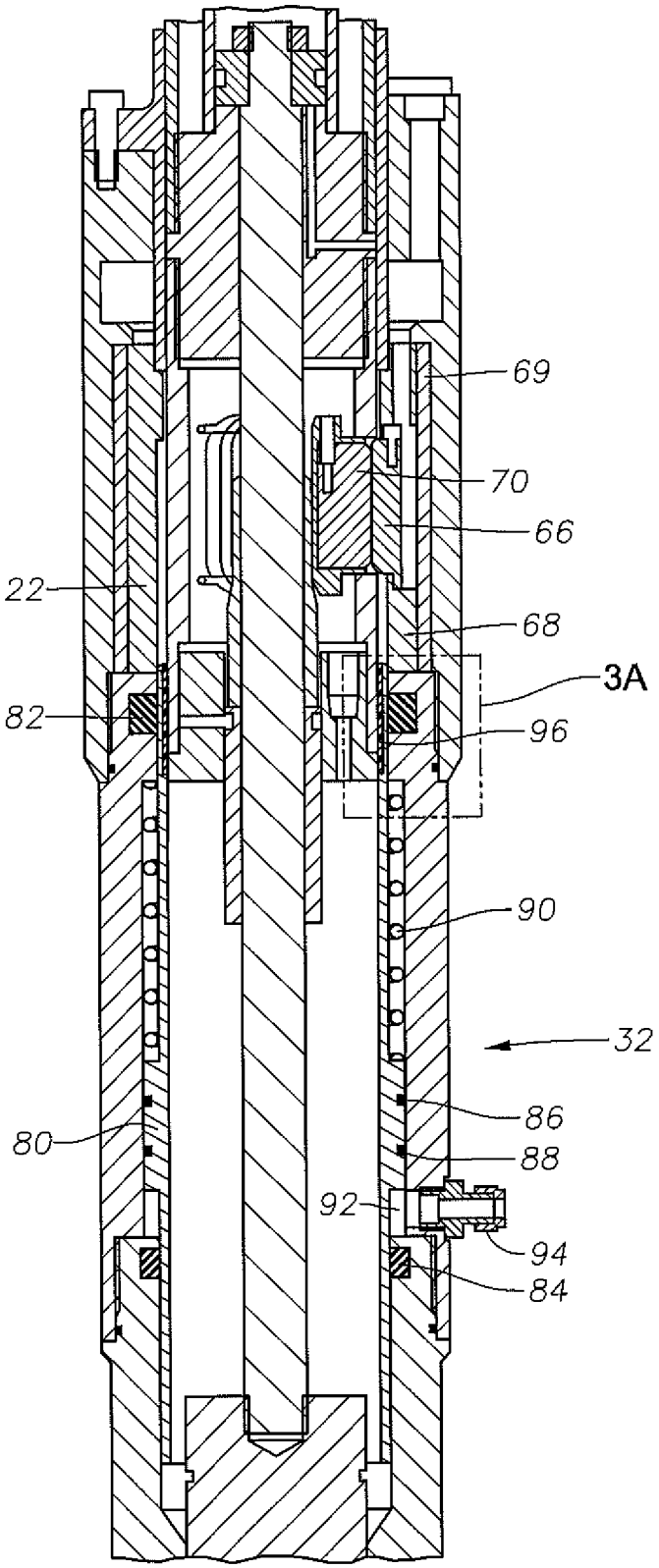
FIG. 3 is a vertical cross-sectional view of an assembly according to the present invention with the wet connect components of the electrical submersible pump of FIG. 1 in electrical connection with each other.

The hydraulic mechanism for isolation of the wet connect electrical contacts 66 and 70 from each other according to the present invention is illustrated schematically in FIG. 1 and in detail in FIGS. 2 and 3. A conductive cylindrical electrical sleeve or collar assembly 80 (FIG. 2) according to the present invention is located below the insulative sleeve 68 within the receptacle assembly 32. Hydraulic seals 82 and 84 at upper and lower ends of the sleeve assembly 80 are provided for sealing between the sleeve 80 and an inner wall of the receptacle assembly 32. A set of O-rings or comparable seals 86 and 88 are mounted along outer side walls of the sliding sleeve 80 to provide sealing therebetween during movement of the sliding sleeve 80. A resilient mechanism such as a coil spring 90 is mounted in an annular chamber 92 of the sleeve 80. The spring 90 is compressed when hydraulic pressure is introduced into the chamber 92 to move the sleeve upwardly from the position of FIG. 3 where the electrical connection is made to the position of FIG. 2 where the contacts 66 and 70 are electrically isolated. The hydraulic pressure applied in chamber 92 is furnished by one or more hydraulic lines 94 in fluid sealing connection with the chamber 92 and extending from the surface along the upper tubing or conduits and the outer housing 22. In alternative embodiments, hydraulic pressure may be supplied from a hydraulic pressure source located at pumping system P.

Figure 2A:
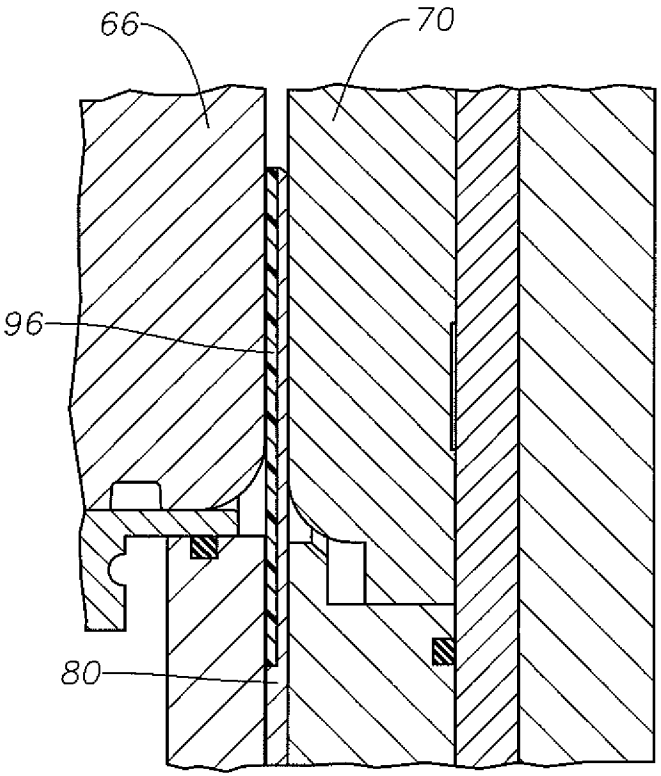
FIG. 2A is an enlarged view of a portion of the structure circled and identified by reference numeral 2A in FIG. 2.

An inner insulative sleeve 96 is mounted or otherwise affixed or applied on an upper interior surface (FIGS. 2A and 3A) of the sleeve 80. The insulative sleeve 96 is formed of a suitable non-conductive material. The material of sleeve 96 could be a thermoplastic such as polyether ether ketone or PEEK, although it should be understood that other non-conductive materials could be used as well. The sleeve 96 has a vertical extent equal to or greater than the vertical dimension of the power transfer wet connect electrical contacts 70 to prevent the contact from engagement with other electrical components during isolation as shown in FIG. 2. The outer surface of the sleeve 80 along its vertical extent is conductive. The outer upper portions of sleeve 80 remain in electrical contact with the multiphase wet connect power supply contacts 66 and thus provides a common electrical ground between the these contacts and their associated supply conductors.

FIGS. 2 and 3 illustrate the elements of the sliding sleeve assembly 80 as the sliding sleeve assembly 80 separates and isolates the downhole deployed receptacle assembly 32 portion of the wet connection from the insertable assembly 30. This separation/isolation allows electrical testing/diagnostics to be performed on the tubular deployed assembly. FIG. 3 illustrates the normal operational state. When isolation for testing purposes is required, hydraulic fluid is supplied to the annular chamber 92, moving the sliding sleeve assembly 80 axially upward, compressing the spring 90. The upward axial movement of the sliding sleeve assembly 80 inserts the inner insulative sleeve 96 between the contacts 66, 70, as shown in FIG. 2. The outer surface of the sleeve 80 remains conductive while the insulative inner sleeve 96 along the upper inner portions breaks the conductor interface when the sleeve 80 is moved to the position shown in FIG. 2. The outer surface of the sleeve 80 however maintains the completed circuit to electrical ground between the phases allowing the power conduit 62 components to be tested for uphole electrical continuity and integrity. Following diagnostic testing, hydraulic fluid pressure is removed from the annular chamber 92, allowing the spring 90 to uncompress and return the sliding sleeve assembly 80 to the position of FIG. 3. In this manner, the electrical connection between contacts 66, 70 is restored.

Another example of separating and isolating the electrical contact between the contacts 66 and 70 is illustrated in FIGS. 4 through 7. The inserted assembly 30 when oriented by the keys 36 in slots 40 aligns the contacts 66 and 70 in the manner described in relation to FIG. 1. The contacts 66 and 70 are urged into radial contact with each other in the manner described in co-pending U.S. patent application Ser. No. 12/413,243 previously referenced. Electrically engaging the contacts 66 and 70 provides a continuous path to flow electricity to the pump motor 24 from the power supply conductors 60.

Figure 4:
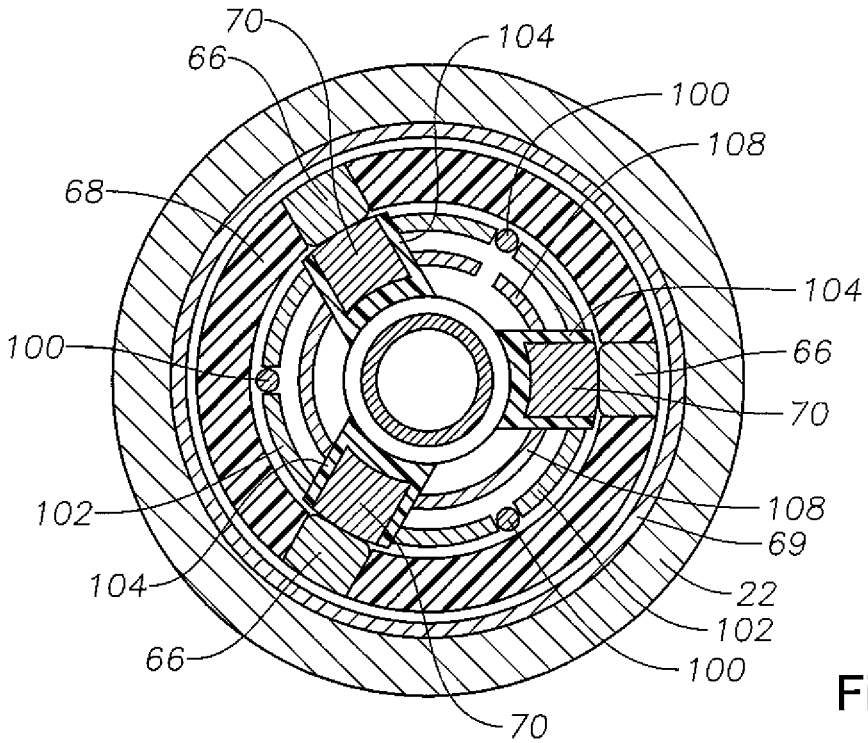
FIG. 4 is a horizontal cross-sectional view of lower portions of an alternate assembly according to the present invention taken along the line 4-4 of FIG. 1 with the wet connect components of the electrical submersible pump of FIG. 1 in electrical connection with each other.

As shown in FIG. 4, a set of circumferentially spaced electrically conductive grounding rods or bars 100 are mounted in grooves or slots formed in a housing sleeve 102. The bars 100 are connected at the lower end of the assembled structure. The wet connect power transfer contacts 70 are mounted in vertically extending insulative channels 104 in housing sleeve 102 at circumferentially spaced positions between the grounding rods 100 and held in place by a retaining spring 108.

Figure 5:
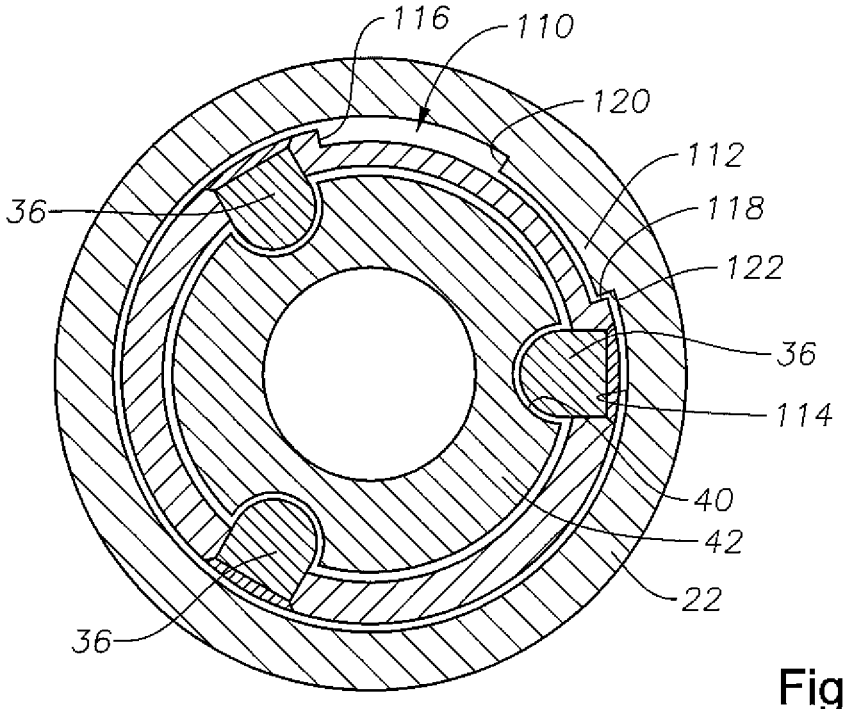
FIG. 5 is a horizontal cross-sectional view of upper portions of the alternate assembly of FIG. 4 according to the present invention taken along the line 5-5 of FIG. 1.

FIG. 5 illustrates upper portions of the inserted assembly 30 according to the present invention when the contacts 66 and 70 are aligned in the position illustrated in FIG. 4. According to the present invention, a recessed shift or rotational travel slot 110 extends around a portion of the periphery of an upper portion of the adapter head 42. The slot 110 receives a vertically extending spline or rib 112 formed extending inwardly along an inner surface 114 of an upper portion of the outer housing 22. The circumferential extent of the spline 112 is less than the circumferential extent of the slot 110 to permit relative rotational movement between the inserted body 30 and the deployed outer housing 22. This permits corresponding rotational movement to separate and isolate the contacts 66 and 70. Vertically extending travel limit surfaces or stops 116 and 118 are formed in the adapter head 42 on opposite sides of the slot 110 to serve as stop limits or contact surfaces for vertically extending travel limit or stop surfaces 120 and 122 on the spline 112.

In the structure as illustrated in FIG. 4, a shifting capability of 60° between the stop locations is provided. Relative rotational movement between the inserted assembly 30 and the deployed outer housing 22 to cause such shifting or relative movement of the spline 112 in the slot 110 can be driven by either hydraulic or electromechanically actuated devices. For example hydraulic motor 55 (FIG. 1) may be supplied with hydraulic pressure from any suitable source to actuate and cause rotation of inserted assembly 30 relative to outer housing 22. The relative rotational movement or shifting can be caused by movement of the inserted assembly 30, the outer housing 22, or both.

Figure 6:
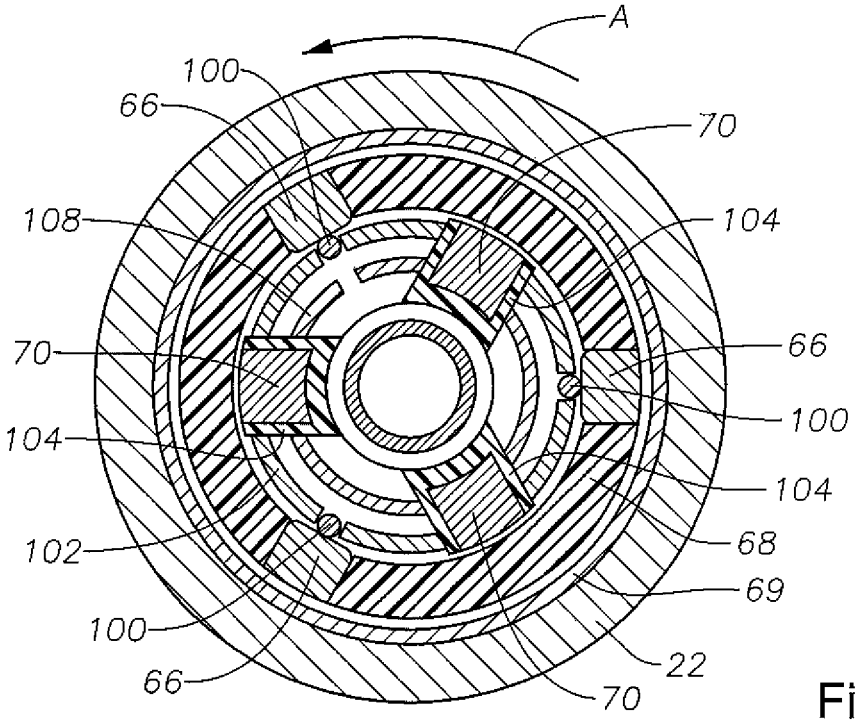
FIG. 6 is a horizontal cross-sectional view of the alternate assembly depicted in FIG. 4 according to the present invention taken along the line 4-4 of FIG. 1, but with the wet connect components of the electrical submersible pump moved to positions isolated from each other.
Figure 7:
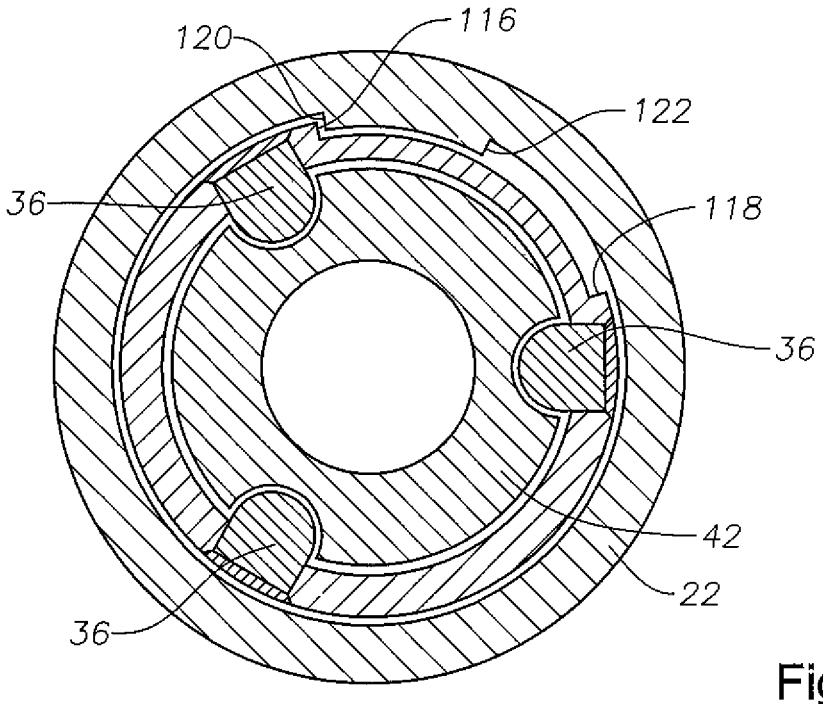
FIG. 7 is a horizontal cross-sectional view of upper portions of the alternate assembly depicted in FIG. 6 taken along the line 5-5 of FIG. 1.

FIGS. 6 and 7 illustrate the completion of the shifting motion after relative rotational movement as indicated by an arrow A. The electrical connection and transfer of electrical current between the contacts 66 and 70 is broken and the grounding bars 100 on the inserted assembly 30 are in electrical connection with the contacts 66, as shown in FIG. 6, due to the rotation of the upper portions to the position shown in FIG. 7 after a 60° rotational shift of spline 112 in the slot 110. This maintains the completed circuit to electrical ground between the phases allowing the power conduit 62 components to be tested for uphole electrical continuity and integrity. Following diagnostic testing, a 60° rotational shift of the spline 112 in the slot 110 in the opposite direction restores the electrical connection between the contacts 66, 70.

Accordingly, the disclosed embodiments provide numerous advantages. For example, the disclosed embodiments provide a method to isolate wet connection components for diagnostic testing in place within a wellbore.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. An electric submersible pumping system comprising:

a pumping system deployable through a well tubing string and having a pump with a fluid inlet and a pump motor mechanically coupled to the pump;

a receptacle assembly adapted to be secured to a lower end of the tubing string;

a power conduit for placement alongside the tubing string;

wherein the power conduit is electrically connected to a plurality of supply contacts formed within the receptacle assembly;

a wet connect assembly coupled to the pumping system, having a plurality of transfer contacts and having motor lead lines electrically connecting the plurality of transfer contacts to the pump motor;

wherein the pumping system is deployable through the tubing string so that the wet connect assembly lands in the receptacle assembly with the supply contacts and the transfer contacts electrically connected to each other to supply electrical power through the power conduit to the motor; and an isolation assembly within the receptacle assembly that is selectively movable from a power transfer position to an isolation position to isolate the transfer contacts from the supply contacts for diagnostic testing of the power conduit.

2. The electric submersible pumping system of claim 1, wherein the isolation assembly also places the supply contacts in electrical communication while in the isolation position.

3. The electric submersible pumping system of claim 1, wherein the isolation assembly comprises:

an annular chamber defined by the receptacle assembly;

a sliding sleeve disposed within the annular chamber and configured to move axially within the receptacle assembly; and wherein hydraulic pressure supplied to the annular chamber moves the sliding sleeve to the isolation position between the supply contacts and the transfer contacts.

4. The electric submersible pumping system of claim 3, further comprising:

an upper portion of the sleeve having an electrically conductive surface on an outer diameter of the upper portion to place the supply contacts in electrical communication; and the upper portion of the sleeve bearing having an electrically insulative surface in its inside diameter to electrically insulate the supply contacts from the transfer contacts.

5. The electric submersible pumping system of claim 3, further comprising a spring positioned on the sliding sleeve opposite the annular chamber that biases the sleeve away from the isolation position.

6. The electric submersible pumping system of claim 1, wherein the isolation assembly separates the supply contacts from the transfer contacts by relative rotation between the wet connect assembly and the receptacle assembly.

7. The electric submersible pumping system of claim 6, further comprising:

a rotational travel slot formed within the wet connect assembly, the rotational travel slot extending around a portion of the circumference of the wet connect assembly;

a spline formed on an inner diameter portion of the receptacle assembly, the spline extending into the rotational travel slot when the wet connect assembly is disposed within the receptacle assembly and the spline having a circumferential length less than the circumferential length of the rotational travel slot; and wherein rotation of the receptacle assembly relative to the wet connect assembly from the power transfer position to the isolated position moves the spline through the slot.

8. The electric submersible pumping system of claim 6, further comprising grounding contacts disposed within the wet connect assembly and electrically connected to each other such that rotation from the power transfer position to the isolated position causes the grounding contacts to place the supply contacts in electrical communication.

9. An electric submersible pumping system comprising:

a well tubing string disposed within a wellbore;

a pumping system deployable through the well tubing string and having a pump with a fluid inlet and a pump motor mechanically coupled to the pump;

a receptacle assembly adapted to be secured to a lower end of the tubing string;

a power conduit for placement alongside the tubing string;

wherein the power conduit is electrically connected to a plurality of supply contacts formed within the receptacle assembly;

a wet connect assembly coupled to the pumping system, having a plurality of transfer contacts and having motor lead lines electrically connecting the plurality of transfer contacts to the pump motor;

wherein the pumping system is deployable through the tubing string so that the wet connect assembly lands in the receptacle assembly with the supply contacts and the transfer contacts electrically connected to each other to supply electrical power through the power conduit to the motor; and a hydraulic isolation assembly within the receptacle assembly that is selectively movable from a power transfer position to an isolation position to isolate the transfer contacts from the supply contacts for diagnostic testing of the power conduit.

10. The electric submersible pumping system of claim 9, wherein the isolation assembly also places the supply contacts in electrical communication while in the isolation position.

11. The electric submersible pumping system of claim 9, wherein the isolation assembly comprises:

an annular chamber defined by the receptacle assembly;

a sliding sleeve disposed within the annular chamber and configured to move axially within the receptacle assembly; and wherein hydraulic pressure supplied to the annular chamber moves the sliding sleeve to the isolation position between the supply contacts and the transfer contacts.

12. The electric submersible pumping system of claim 11, further comprising:

an upper portion of the sleeve having an electrically conductive surface on an outer diameter of the upper portion to place the supply contacts in electrical communication; and the upper portion of the sleeve bearing having an electrically insulative surface in its inside diameter to electrically insulate the supply contacts from the transfer contacts.

13. The electric submersible pumping system of claim 11, further comprising a spring positioned on the sliding sleeve opposite the annular chamber that biases the sleeve away from the isolation position.

14. The electric submersible pumping system of claim 9, wherein the isolation assembly separates the supply contacts from the transfer contacts by relative rotation between the wet connect assembly and the receptacle assembly.

15. The electric submersible pumping system of claim 14, further comprising:

a rotational travel slot formed within the wet connect assembly, the rotational travel slot extending around a portion of the circumference of the wet connect assembly;

a spline formed on an inner diameter portion of the receptacle assembly, the spline extending into the rotational travel slot when the wet connect assembly is disposed within the receptacle assembly and the spline having a circumferential length less than the circumferential length of the rotational travel slot;

a hydraulically actuated rotary device configured to rotate the wet connect assembly relative to the receptacle assembly; and wherein rotation of the receptacle assembly relative to the wet connect assembly from the power transfer position to the isolated position moves the spline through the slot.

16. The electric submersible pumping system of claim 14, further comprising grounding contacts disposed within the wet connect assembly and electrically connected to each other such that rotation from the power transfer position to the isolated position causes the grounding contacts to place the supply contacts in electrical communication.

17. A method for powering an electric motor of an electric submersible pump comprising:

(a) providing a receptacle assembly on a lower end of a tubing string and having a plurality of supply contacts on an inner diameter of the receptacle assembly;

(b) deploying the tubing string in a well and extending a power cable from the receptacle assembly alongside the tubing string;

(c) providing the submersible pump with a wet connect assembly having a plurality of transfer contacts formed on an outer diameter of the wet connect assembly and motor lead lines electrically connecting the transfer contacts to the electric motor;

(d) lowering the submersible pump through the tubing string and engaging the transfer contacts with the supply contacts;

(e) supplying electrical power to the electric motor through the power cable, the supply contacts, the transfer contacts, and the motor lead lines to operate the submersible pump and to test integrity of the power cable; and (f) remotely actuating an isolation assembly formed within the receptacle assembly to separate the transfer contacts from the supply contacts without withdrawing the submersible pump from the tubing string.

18. The method of claim 17, wherein step (f) further comprises supplying hydraulic pressure to the isolation assembly to axially move a sliding sleeve between the supply contacts and the transfer contacts relative to an axis of the wet connect assembly.

19. The method of claim 17, wherein step (f) also comprises placing the supply contacts in electrical communication with each other the submersible pump.

20. The method of claim 17, wherein step (f) further comprises rotating the wet connect assembly relative to the receptacle assembly to circumferentially separate the supply contacts from the transfer contacts.

21. The method of claim 20, wherein rotating the wet connect assembly relative to the receptacle assembly places the supply contacts in electrical communication with each other.

* * * * *